US010050394B2

(12) United States Patent
Aporius et al.

(10) Patent No.: US 10,050,394 B2
(45) Date of Patent: Aug. 14, 2018

(54) CONTACT ELEMENT FOR A PLUG ARRANGEMENT IN A BUS SYSTEM, MORE PARTICULARLY AN EXTERNALLY ROUTED BUS SYSTEM

(71) Applicant: Weidmueller Interface GmbH & Co. KG, Detmold (DE)

(72) Inventors: Stefan Aporius, Detmold (DE); Bernd Van Giesen, Detmold (DE)

( * ) Notice: Subject to any disclaimer, the term of this patent is extended or adjusted under 35 U.S.C. 154(b) by 0 days.

(21) Appl. No.: 15/902,217

(22) Filed: Feb. 22, 2018

(65) Prior Publication Data

US 2018/0183196 A1 Jun. 28, 2018

Related U.S. Application Data

(63) Continuation of application No. 15/626,600, filed on Jun. 19, 2017, which is a continuation of application (Continued)

(30) Foreign Application Priority Data

Jul. 31, 2013 (DE) ..... 20 2013 103 444 U

(51) Int. Cl.

| | |
|---|---|
| ***H01R 25/14*** | (2006.01) |
| ***H01R 4/48*** | (2006.01) |
| ***H01R 27/02*** | (2006.01) |
| ***H01R 31/02*** | (2006.01) |
| ***H01R 25/16*** | (2006.01) |
| ***H01R 13/11*** | (2006.01) |
| ***H01R 12/70*** | (2011.01) |
| *H01R 13/18* | (2006.01) |

(52) U.S. Cl.

CPC ..... *H01R 25/145* (2013.01); *H01R 4/48* (2013.01); *H01R 12/7088* (2013.01); *H01R 13/113* (2013.01); *H01R 25/162* (2013.01); *H01R 27/02* (2013.01); *H01R 31/02* (2013.01); *H01R 12/7082* (2013.01); *H01R 13/18* (2013.01)

(58) Field of Classification Search

CPC .. H01R 4/48; H01R 12/7082; H01R 12/7088; H01R 13/11; H01R 13/18; H01R 13/113; H01R 13/245; H01R 25/145; H01R 25/162; H01R 31/02

USPC ..... 439/122, 251, 839, 845, 856, 857, 861

See application file for complete search history.

(56) References Cited

U.S. PATENT DOCUMENTS

| | | | |
|---|---|---|---|
| 3,132,913 | A | 5/1964 | Pohl |
| 4,351,583 | A | 9/1982 | Belttary |

(Continued)

FOREIGN PATENT DOCUMENTS

| | | |
|---|---|---|
| DE | 24 00 509 A1 | 7/1975 |
| DE | 690 17 980 T2 | 2/1991 |

(Continued)

*Primary Examiner* — Tulsidas C Patel
*Assistant Examiner* — Travis Chambers
(74) *Attorney, Agent, or Firm* — Laubscher, Spendlove & Laubscher, P.C.

(57) ABSTRACT

A resilient conductive contact spring is bent to define at least three tulip-shaped receptacles for receiving conductive devices that are to be electrically connected together by the contact spring. The contact spring can be included in a socket arrangement for connecting an electrical component mounted within a housing with a bus bar power supply system arranged outside the housing.

11 Claims, 6 Drawing Sheets

Related U.S. Application Data

No. 14/904,688, filed as application No. PCT/EP2014/064921 on Jul. 11, 2014.

(56) References Cited

U.S. PATENT DOCUMENTS

| | | | | |
|---|---|---|---|---|
| 4,553,799 | A | 11/1985 | Deters | |
| 4,952,164 | A | 8/1990 | French et al. | |
| 5,417,589 | A | 5/1995 | Terada | |
| 5,431,576 | A | 7/1995 | Mattews | |
| 5,588,884 | A | 12/1996 | Rudoy et al. | |
| 5,875,101 | A * | 2/1999 | Asselta | H05K 7/1457 361/775 |
| 6,568,955 | B2 * | 5/2003 | Hotea | H01R 12/79 439/260 |
| 6,722,926 | B2 * | 4/2004 | Chevassmore | H01R 13/113 439/721 |
| 7,581,972 | B2 * | 9/2009 | Daamen | H01R 13/6315 439/249 |
| 7,892,050 | B2 * | 2/2011 | Pavlovic | H01R 9/245 439/250 |
| 7,967,648 | B2 * | 6/2011 | Byrne | H01R 13/113 439/856 |
| 8,182,299 | B2 * | 5/2012 | Schrader | H01R 13/18 439/839 |
| 8,388,389 | B2 * | 3/2013 | Costello | H01R 13/18 439/637 |
| 8,449,338 | B2 | 5/2013 | Gong et al. | |
| 8,764,464 | B2 | 7/2014 | Buck et al. | |
| 8,986,030 | B2 | 3/2015 | Billman et al. | |
| 9,142,902 | B2 | 9/2015 | Glick et al. | |
| 9,451,712 | B2 | 9/2016 | Sichmann et al. | |
| 2005/0085140 | A1 | 4/2005 | Lai | |
| 2007/0259574 | A1 | 11/2007 | Kirstein et al. | |
| 2008/0146054 | A1 | 6/2008 | Byrne | |

FOREIGN PATENT DOCUMENTS

| | | | |
|---|---|---|---|
| DE | 694 27 781 | T2 | 7/1994 |
| DE | 197 06 943 | A1 | 8/1998 |
| DE | 10 2007 017 593 | A1 | 11/2007 |
| EP | 2 048 746 | A1 | 4/2009 |
| WO | 2006/091196 | A1 | 8/2006 |
| WO | 2009/056418 | A1 | 5/2009 |

* cited by examiner

Fig. 3b
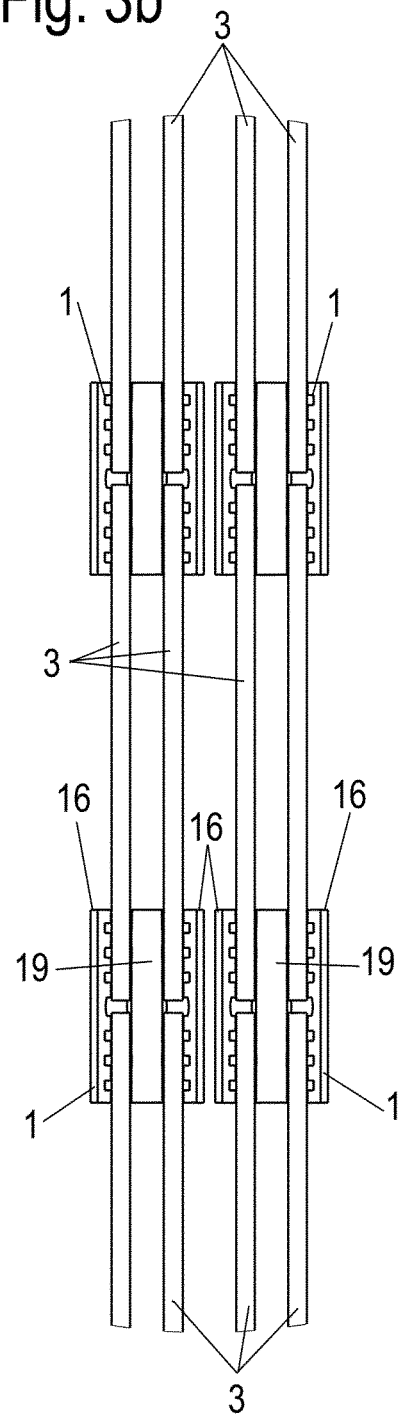
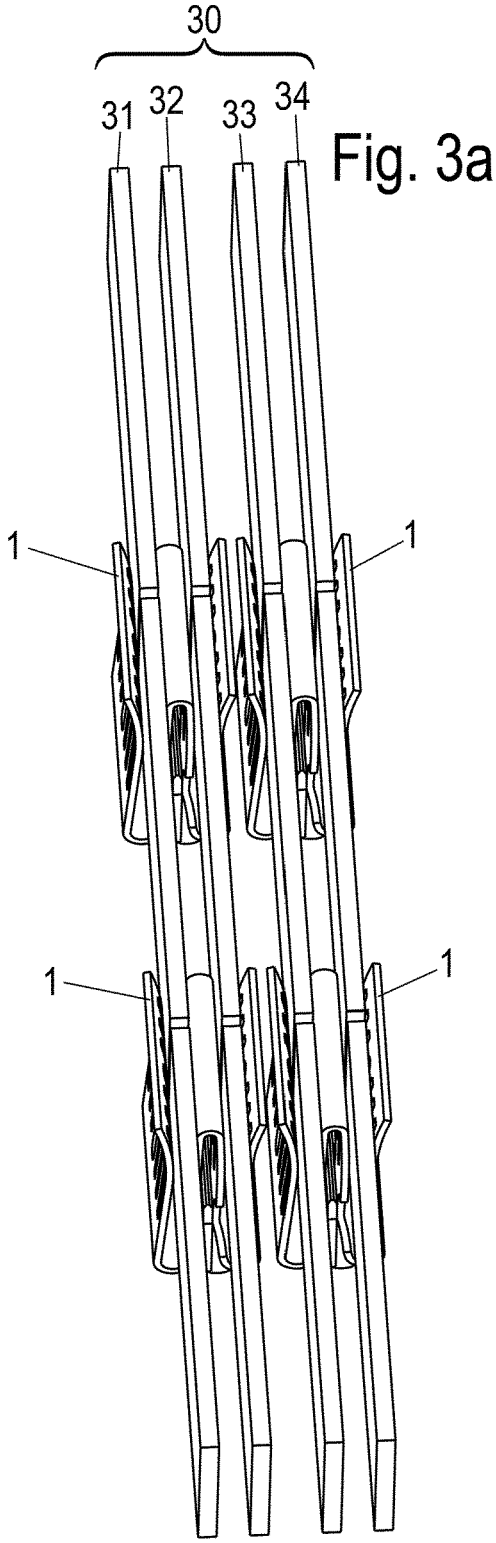
Fig. 3a

CONTACT ELEMENT FOR A PLUG ARRANGEMENT IN A BUS SYSTEM, MORE PARTICULARLY AN EXTERNALLY ROUTED BUS SYSTEM

CROSS-REFERENCE TO RELATED APPLICATIONS

This application is a continuation of U.S. patent application Ser. No. 15/626,600, filed Jun. 19, 2017, which is a continuation of Ser. No. 14/904,688, filed Jan. 12, 2016 entitled CONTACT ELEMENT FOR A PLUG ARRANGEMENT IN A BUS SYSTEM, MORE PARTICULARLY AN EXTERNALLY ROUTED BUS SYSTEM. Application Ser. No. 14/904,688 is a § 371 national stage entry of the PCT International Application No. PCT/EP2014/064921 filed Jul. 11, 2014, which claims priority of the German application No. DE202013103444.4, filed Jul. 31, 2013. The entire content of these applications is incorporated herein by reference.

BACKGROUND OF THE INVENTION

Field of the Invention

A resilient conductive contact spring is bent to define at least three tulip-shaped receptacles for receiving conductive devices that are to be electrically connected together by the contact spring. The contact spring can be included in a socket arrangement for connecting an electrical component mounted within a housing with a bus bar power supply system arranged outside the housing.

Description of Related Art

The invention relates to a contact element provided for electrically connecting electrical connecting elements of an externally routed bus system, especially bus bars and/or plug connectors.

Electrical power distribution technology requires bus systems that ensure electrical supply and electrical signals to spatially distributed electrical components. Such electrical components include electrical equipment that ensures electrical supply, e.g., power supply units and line filters, particularly for frequency converters and servo controllers. Other electrical devices may, in principle, be connected to such a bus system.

To ensure simple installation and quick access to such a bus system, electrical connections, especially in the form of bus bars, are often routed outside of the electrical components. This makes tapping into the electrical supply and electrical signals at preferably any point of the bus system very simple and easy.

German patent No. DE 20 2013 102 303.5 discloses a row component arrangement with such a bus system. The row component arrangement comprises multiple row components that may be arranged adjacent one another on a mounting base, particularly a support rail. The row components have an electronics housing and an electrical assembly with electrical components, which assembly is preferably arranged on a circuit board and in the electronic housing. Each have a socket structure comprising a contact element in order to connect the electrical assembly to the externally routed bus system. The contact element is designed as a clamping spring and is S-shaped, such that it has a first tulip-shaped receptacle for connecting a bus bar, and a second tulip-shaped receptacle for connecting to the electrical assembly.

The object of the present invention is to devise an alternative contact element, which will make it possible to connect an electrical device, particularly a row component, to an externally routed bus system, and which, compared with the prior-art contact element, may be used in a more versatile fashion and is better suited for power distribution. Moreover, an electrical device, particularly a row component with such a contact element, is to be devised.

SUMMARY OF THE INVENTION

Accordingly, a primary object of the invention is to provide a resilient conductive contact spring is bent to define at least three tulip-shaped receptacles for receiving conductive devices that are to be electrically connected together by the contact spring.

Another object of the invention is to provide a socket arrangement including the contact spring for connecting an electrical component mounted within a housing with a bus bar power supply system arranged outside the housing.

Hence, a contact element is devised and provided to connect electrical connecting elements of an externally routed bus system, particularly bus bars and/or plug connectors, and having at least three tulip-shaped receptacles for receiving the electrical connecting elements. In this way, two tulip-shaped receptacles for receiving connecting elements, preferably of the bus system, particularly bus bars, become available. Thus, either more connecting elements of the bus system may be connected to the contact element, or else a tulip-shaped receptacle is provided in order to receive a connecting element, particularly one end of a bus bar, such that a large contact surface for contacting the connecting element becomes available, thereby allowing for more contact points and making the contact element especially well-suited for power currents.

The tulip-shaped receptacles are preferably alternately accessible from a first direction, or a second direction opposite the first direction. In this embodiment, it is preferable that the tulip-shaped receptacles accessible from the first direction are provided for attaching the connecting elements of the bus system, and that the tulip-shaped receptacle accessible from the second direction is provided for connecting an electrical assembly.

Contact elements with more than three tulip-shaped receptacles are also preferred. It is preferable here that at least two of the tulip-shaped receptacles for connecting the bus system be provided.

The contact element is preferably made of an electrically highly conductive material, so that it conducts electricity well. It is preferably made as a stamped and bent part, preferably as an integral stamped and bent part. It is especially preferable that the contact element be made of a strip material, e.g., highly conductive sheet metal, preferably of copper. It is likewise preferable that it has good elastic properties, making it flex, when electrical connecting elements are inserted against a restoring force, and act as a clamping spring. This will lock the connection elements arranged in the receptacle spaces in the contact element.

For this reason, the tulip-shaped receptacles have two longitudinal members, between which the tulip-shaped receptacle is arranged. The longitudinal members are preferably interconnected by transverse members.

To improve even further the electrical contact and/or the current-carrying capacity, contacting means are preferably provided on the longitudinal members. As contacting means are preferred, e.g., embossments, which are raised in the tulip-shaped receptacle, or perforations, such that the longitudinal members form at least partly in a lamella-like fashion.

In a first embodiment, the contact element is made in one piece. This embodiment allows the element to be made very inexpensively and quickly and easily mountable, as a single component.

In a second embodiment, the contact element is made from a plurality of receptacle parts. Here, identically designed receptacle parts are preferably used for the same contact element. In a preferred embodiment, the receptacle parts are each U-shaped. A contact element with three tulip-shaped receptacles is thereby preferably made of three receptacle parts. However, an embodiment, in which the receptacle parts are interconnected by means of receptacle connectors, is likewise preferred. For instance, in this embodiment, a contact element with three tulip-shaped receptacles consisting of two receptacle parts is made with one receptacle connector, while a contact element from five tulip-shaped receptacles consisting of three receptacle parts is made from two receptacle connectors. Thus, for tulip-shaped receptacles, n−1 receptacle parts and n−2 receptacle connectors are always needed. Likewise, the receptacle connectors are preferably U-shaped, but may be made of a less expensive material. Furthermore, a contact element of any size may be made from such receptacle parts. What's more, the receptacle connector may also be used to join together multiple contact elements with multiple tulip-shaped receptacles.

In another embodiment, the contact element includes a cover spring, e.g., made of resilient steel. The cover spring is provided in order to exert a clamping force on the contact element, and preferably acting in and against one clamping direction. The clamping direction extends preferably perpendicularly to the first and/or second direction. Thus, the cover spring supports the contact element and respectively the restoring force, which acts on a connecting element arranged in the contact element. It is preferred that the cover spring is roughly U-shaped in the cross section.

The object is furthermore achieved with a socket structure having a contact element and at least one electrical connecting element provided for electrical connection of the contact element with an electrical assembly. For example, a connector represents such an electrical connection element.

Preferably, the socket structure also comprises at least two electrical connection elements of an externally routed bus system, particularly two bus bars. The bus bars are preferably arranged in alignment with one another and locked in the same tulip-shaped receptacle. In this arrangement, the tulip-shaped receptacles accessible from the first direction may be used for a bus line. Thus, at least two bus lines may be connected with the same contact element to the electrical assembly, or similarly preferably, the bus bars are each inserted into a tulip-shaped receptacle of the contact element. This will require two tulip-shaped receptacles for the same bus line. However, the contact surface toward the bus bars is greater, so that the arrangement is particularly suitable for power currents.

The socket structure preferably includes a housing, wherein the contact element is arranged. The housing is provided primarily as contact protection for the operator.

The object is additionally achieved with an electrical device, particularly a row component. The electrical device preferably includes an electrical assembly, as well as a socket structure provided for electrically connecting the electrical assembly with the externally routed bus system, and which includes a contact element according to the invention.

BRIEF DESCRIPTION OF THE DRAWINGS

Other objects and advantages of the invention will become apparent from a study of the following specification, when viewed in the light of the accompanying drawing, in which:

FIG. 3*a* is a top perspective view of a first bus bar arrangement using the contact springs of FIG. 1*a*, and FIG. 3*b* is a top plan view of the apparatus of FIG. 3*a;*

DETAILED DESCRIPTION OF THE INVENTION

Figure 1A:
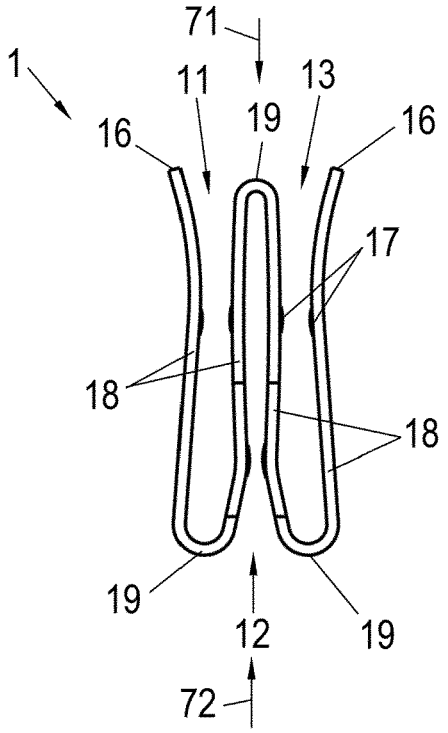
FIG. 1*a* is a side elevation view of a first embodiment of the contact spring of the present invention.

Referring first more particularly to FIG. 1*a*, the electrical contact spring (or resilient contact) 1 is made of a conductive resilient sheet material, such as steel. It is thereby designed to be resilient and has a restoring force. It is produced as a stamped and bent part in one piece, and is thus very cost effective.

In one cross-section, the contact spring it generally W-shaped, and has three tulip-shaped receptacles 11, 12, 13. A W-shaped or roughly W-shaped contact spring entails that the two tulip-shaped receptacles 11, 13 are accessible from a first direction 71, while the third tulip-shaped receptacle 12 is accessible from a second direction 72, opposite the first direction 71. The tulip-shaped receptacle 12, which is accessible from the opposite direction 72, is arranged between the two tulip-shaped receptacles 11, 13, which are accessible from the first direction 71.

The tulip-shaped receptacles 11, 12, 13 are arranged between two longitudinal leg portions 18 of contact spring 1, and are interconnected by the transverse portions 19. The transverse portions 19 are here roughly arc-shaped. The longitudinal portions 18 may be bent apart against the restoring force against a clamping direction 73, which extends transversely to the first direction 71. Electrically conductive contact elements 3, 4 inserted in the tulip-shaped receptacles 11, 12, 13 therefore become locked due to the restoring force in contact element 1.

Contact spring 1 has two open ends 16 on two outer longitudinal portions 18, while two inner longitudinal portion 18 limit two adjacent tulip-shaped receptacles 11, 12, 13 accessible from the opposite directions 71, 72. Contact protrusions 17 are provided on the inner surfaces of the longitudinal leg portions 18, and formed here as embossments protruding into the tulip-shaped receptacles 11, 12, 13.

Figure 4B:
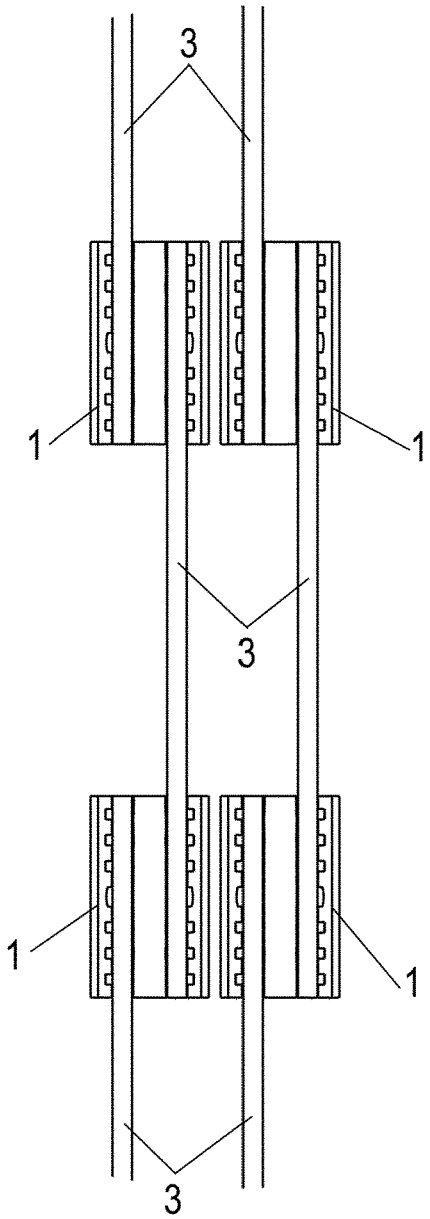
FIG. 4*b* is a top plan view of the apparatus of FIG. 4*a*.

The tulip-shaped receptacles 11, 12, 13 are provided to receive the electrical contact elements 3, 4. It is desirable here that the two tulip-shaped receptacles 11, 13 accessible from the first direction 71 for receiving the bus bars 3 of one or two bus lines 31, 32, 33, 34 of a bus system 30 (see FIGS. 3 and 4). In this embodiment, each of the two bus lines 31, 32 and 33, 34 carries an identical electrical potential. The tulip-shaped receptacle 12 accessible from the second direction 72 is preferably provided for receiving an electrical connection element 4, which connects the bus bars 3 to an electrical assembly of an electrical device 101 (see FIG. 5), particularly a row component. This electrical connection element is preferably designed as a plug connector 4 (FIG. 1*b*).

Contact spring 1 is preferably arranged in a housing 106. In this embodiment, it may be inserted modularly into such an electric device 101 as a socket structure 100. Such a socket structure 100 is shown schematically in FIGS. 1*b* and 5.

Figure 1C:
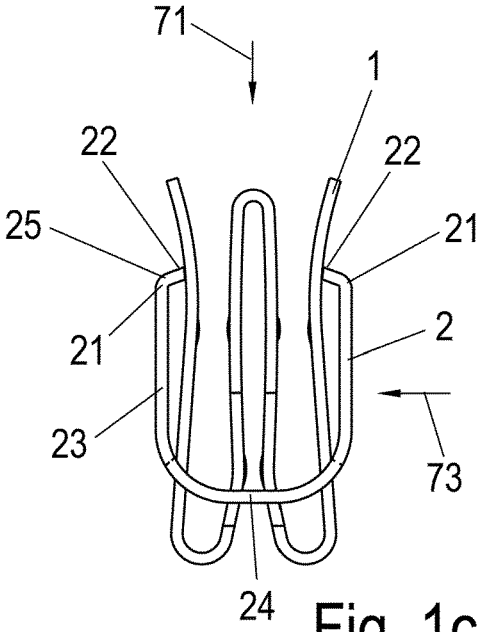
FIGS. 1*c*, 1*d*, and 1*e* are side elevation, front perspective, and front exploded perspective views, respectively, of another embodiment of the contact spring of the present invention.
Figure 1B:
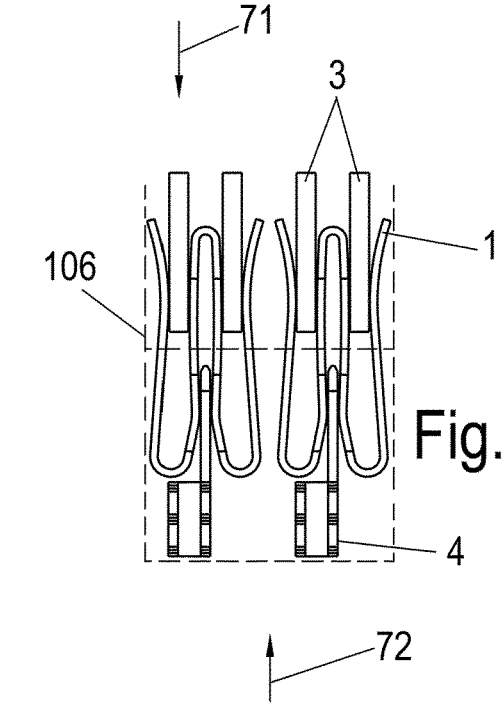
FIG. 1*b* is a detailed side elevation view of a socket connection arrangement according to FIG. 5.

FIG. 1*c* shows the contact element 1 with a cover spring 2 made of, e.g., steel. In the cross-section, the cover spring 2 is roughly U-shaped and has two open cover spring ends 22. In the area of the cover spring ends 22, a bend 21 is provided at the longitudinal portions 23 of the cover spring, which longitudinal portions 23 are interconnected by transverse portion 2, so that the cover springs 2 may be bent apart against a restoring force against a clamping direction 73. The bends 21 are formed precisely such that at the open ends 22 of the cover spring, so that a cross force 25 extends opposite the clamping force 73.

Figure 1D:
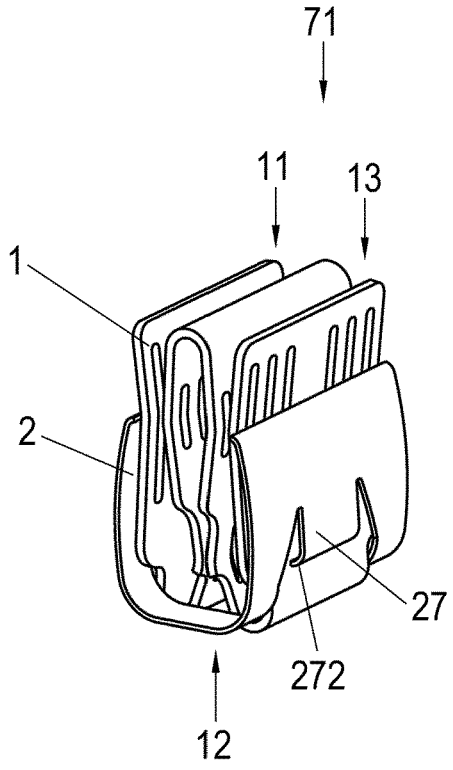
Figure 1E:
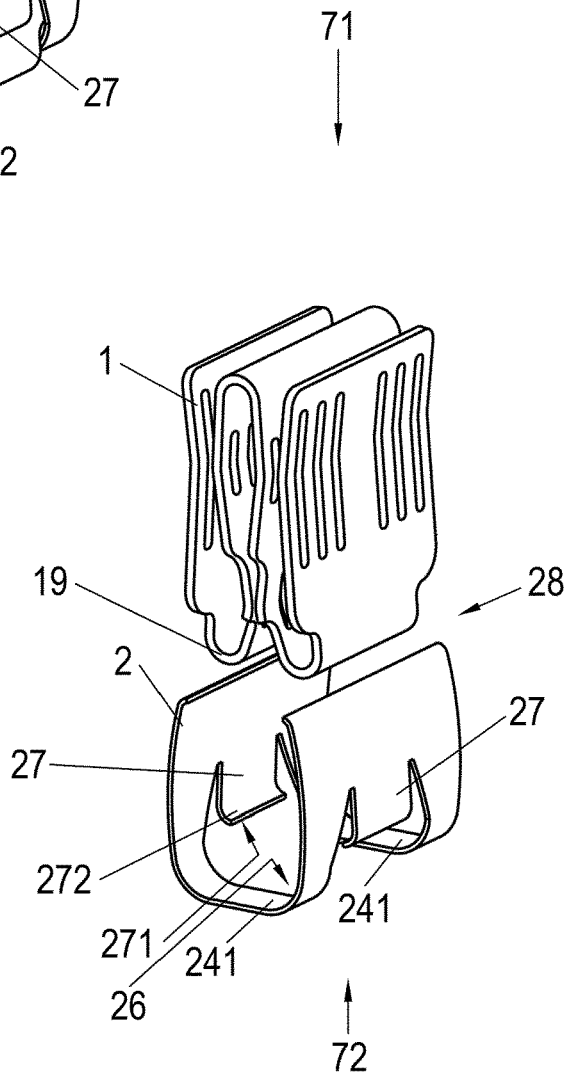

As shown in FIGS. 1*d* and 1*e*, in order for the tulip-shaped receptacle 12, which is accessible from the second direction 72, to be accessible also at the cover spring 2 arranged on contact element 1, the cover spring 2 contains a through opening 26 arranged in the transverse portion 24 of the cover spring, which opening extends partially into the longitudinal leg portions 23 of the cover spring. The transverse portion 24 of the cover spring is therefore divided into two portions 241 of the cover spring.

In order to insert contact element 1 into the opening 26, the two transverse members 19 of contact element 1 arranged on side 28 facing the cover spring 2 are designed to have a narrower width than the remainder of contact element 1 (see FIG. 1*e*).

In each of the longitudinal leg portions 23 of the cover spring 2, a tongue 27 is likewise provided, and is bent at an open extremity of tongue 271, such that a tongue ridge 272 is formed. One tongue ridge 272 extends inwardly toward, while the other tongue ridge 272 extends outwardly against, the clamping direction 73.

Because cover spring 2 is arranged on contact spring 1, contact spring 1 is compressed by the ridges 25 and the tongue ridges 272 due to the restoring force of the cover spring 2. Thus, the cover spring 2 supports contact element 1, as the electrical connection elements 3, 4 are being locked in the tulip-shaped receptacles 11, 12, 13.

Figure 2A:
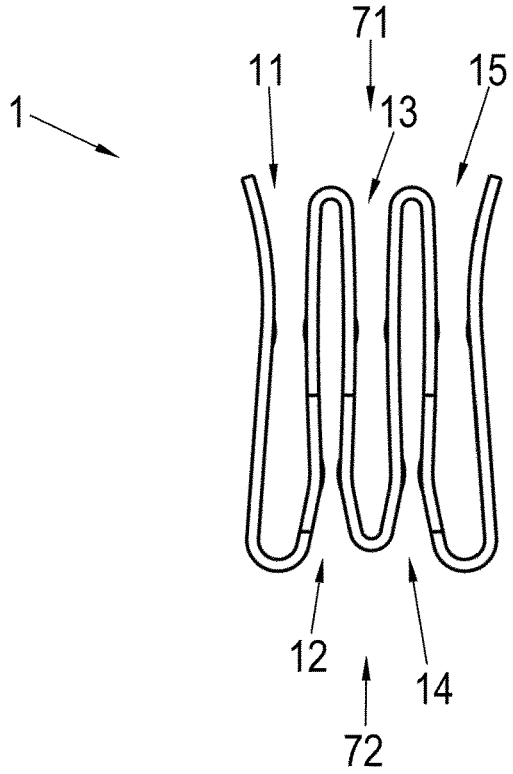
FIG. 2*a* is a side elevation view of another embodiment of the invention.

Referring now to FIG. 2*a*, a contact spring 1' having five tulip-shaped receptacles 11-15 is provided, wherein three receptacles 11, 13, 15 are accessible from the first direction 71, and two receptacles 12, 14 are accessible from the second direction 72. This contact spring 1' is likewise made in one piece, having stamped and bent parts. Preference is given to three of the tulip-shaped receptacles 11, 13, 15, accessible from the first direction 71, for receiving bus bars 3, and two of the tulip-shaped receptacles 12, 14, accessible from the second direction 72, for receiving the contacts 4 for contacting the electrical assembly. However, a reverse arrangement is also possible.

Figure 2B:
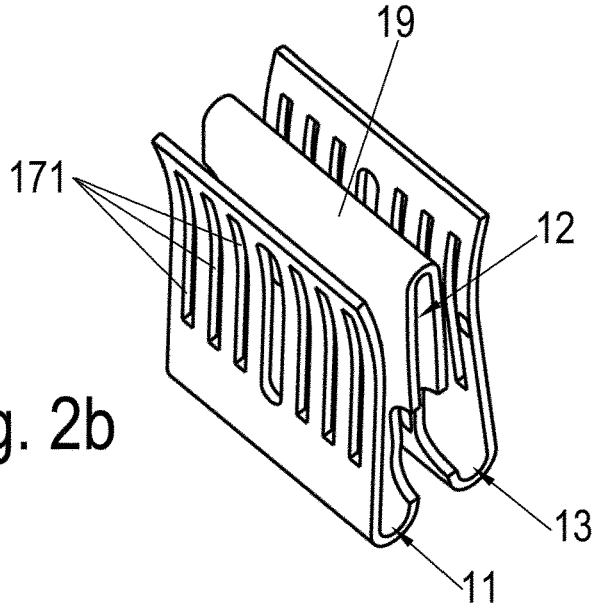
FIG. 2*b* is a perspective view of a modification of the contact spring of FIG. 1*a;*

FIG. 2*b* shows a modification of the contact spring 1 containing perforations provided on the longitudinal leg portions 18, whereby the latter are formed at least partially lamellarly. The perforations are formed smaller in the central longitudinal portions 18*a* than in the outermost longitudinal leg portions 18*a*, so as to increase the current-carrying capacity of contact spring 1.

FIG. 3*a* shows an arrangement of a total of four such contact springs 1 of FIG. 2*b* and bus bars 3. The bus bars 3 are arranged in end-to-end alignment with one another, so that in each case, two bus bars 3 end in the same tulip-shaped receptacle 11, 13. Thus, bus bars 3 here form four bus lines 31, 32, 33, 34 of a bus system 30, whereby in each case, two of the bus lines 31, 32 and 33, 34 carry the same electrical potential.

Figure 4A:
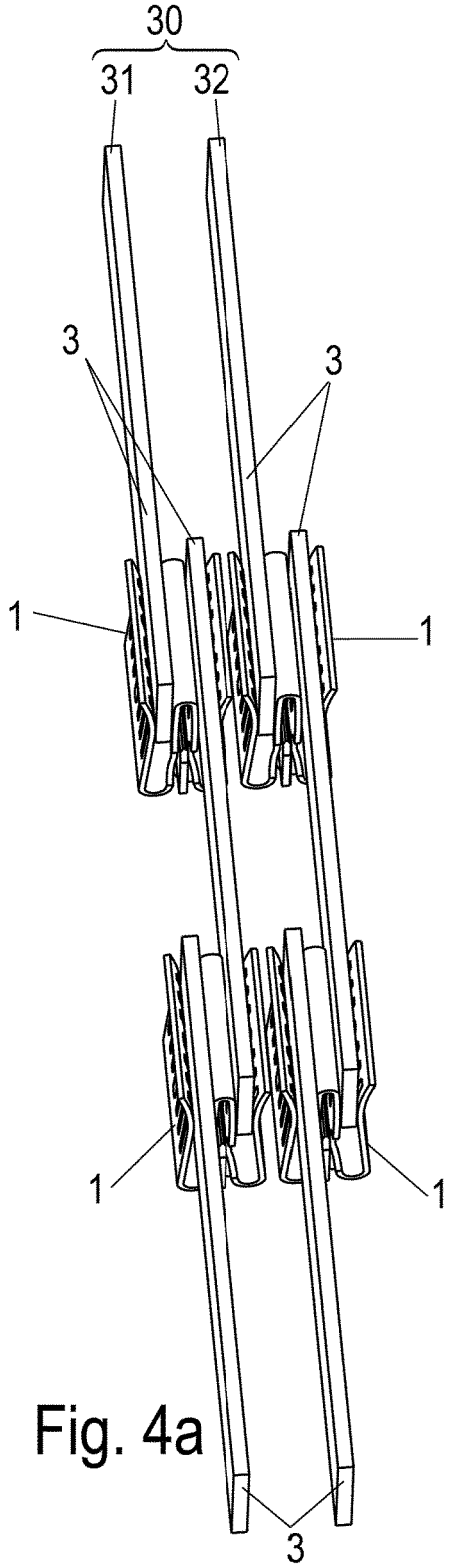
FIG. 4*a* is a top perspective view of a second bus bar arrangement using the contact springs of FIG. 1*a*.

In FIG. 4*a*, each of the tulip-shaped receptacles 11, 13 only receives one bus bar 3. As a result, a contact area formed between bus bars 3 and the longitudinal leg portions 18 of contact springs 1 is greater, when compared with the way it is used in FIG. 3*a*. Hence, the four contact springs 1 guide only two bus lines 31, 32 of the bus system 30. This arrangement is especially suitable for power currents.

Figure 5:
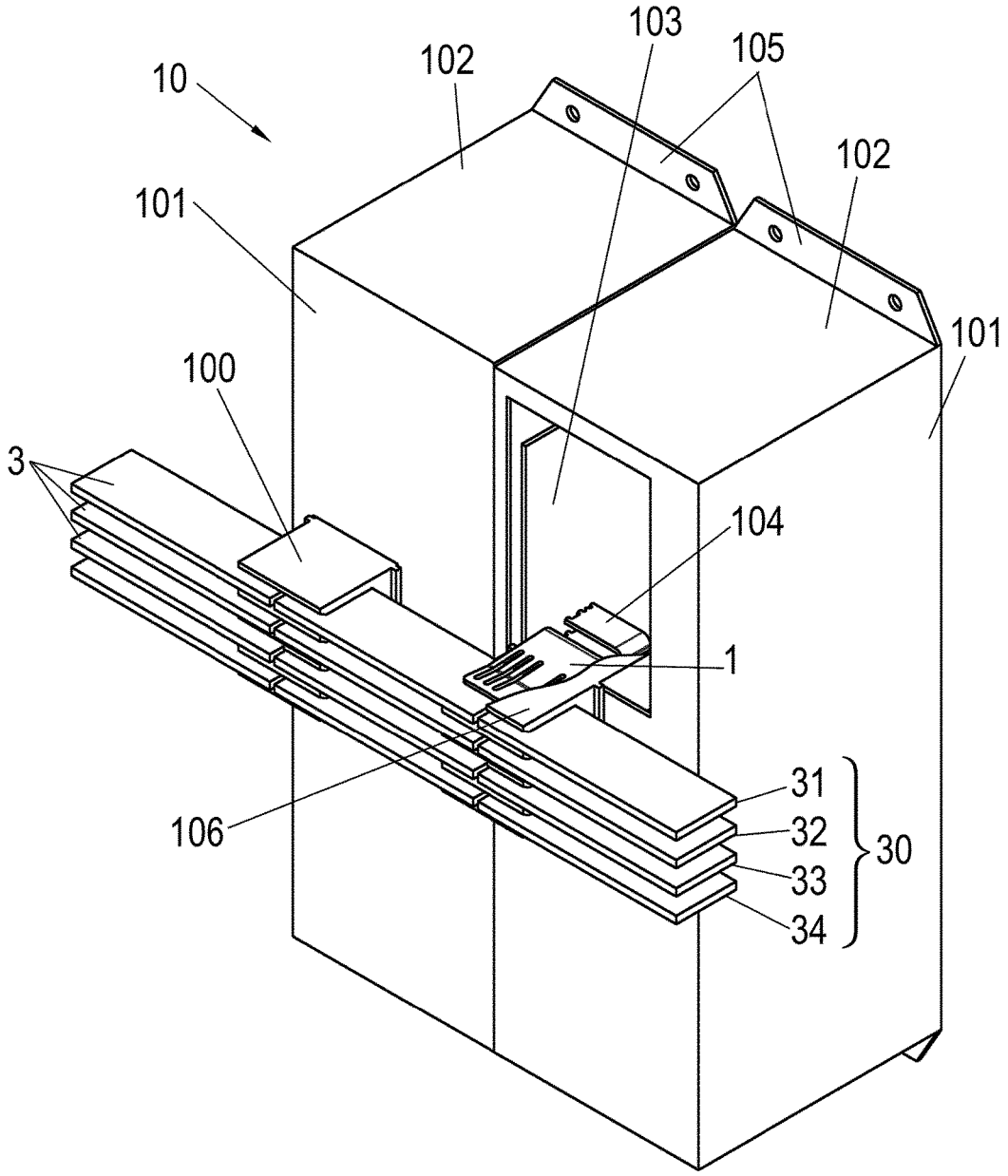
FIG. 5 is a front perspective view of a bus bar power distribution system mounted externally on the front a row of electrical box housings.

FIG. 5 shows an electrical distribution arrangement 10 including two electrical devices 101 formed as row components and arranged adjacent to one another here. In the following, the terms row component and electrical device 101 are used interchangeably.

The row components 101 each have a socket structure 100 that includes an electrical contact spring 1, which is enclosed by a housing 106, which is provided for operator contact protection. The socket structures 100 are each modularly inserted in their row component 101.

The row components 101 each have electrical assemblies comprising electrical printed circuit boards 103. To connect the electrical assemblies electrically with an externally routed bus system 30, solder connectors 104 are provided, which are soldered to the printed circuit board 103 and have a contact (not shown).

The solder contacts 104 are provided as connecting elements in order to connect the electric circuit board 103 with contact spring 1, and contact spring 1 with bus system 30. They are formed as plugs (not shown) on the sides of contact spring 1.

Bus system 30 of the depicted embodiment includes four bus lines 31-34. Each of these are formed by bus bars 3 inserted next to one another by pushing. In this embodiment, the socket structures 100 preferably have two contact springs 1 with three tulip-shaped receptacles 11, 12, 13 (see FIG. 1*b*), such that two bus lines 31-34 each carry the same voltage potential. But, in principle, socket structures 100 having a contact spring 1 with seven tulip-shaped receptacles (not shown) are also conceivable, whereby all the bus lines 31-34 carry the same voltage potential.

In order to arrange the row components 101 adjacent one another, wall mounts 105 are provided as fastening means on the housings 102 of both row components 101.

While in accordance with the provisions of the Patent Statutes the preferred forms and embodiments of the invention have been illustrated and described, it will be apparent to those skilled in the art that changes may be made without deviating from the invention described above.

The invention claimed is:

1. A resilient electrical contact for connecting an electrical component with a bus bar system arranged externally of a housing, comprising:

(a) a contact spring formed from a sheet of resilient conductive material, said contact spring being reversely bent to define at least three open-ended generally tulip-shaped receptacles each having a pair of generally parallel longitudinal leg portions connected at one end by a transverse connecting portion, (b) said contact spring being operable to electrically connect a conductor inserted in one receptacle of said contact spring with a bus bar inserted into another receptacle of said contact spring; and (c) at least two bus bars arranged collinearly longitudinally in end-to-end relation, the adjacent ends of said bus bars extending into a single common receptacle of, and in electrical engagement with, said contact spring.

2. A resilient electrical contact for connecting an electrical component with a bus bar system arranged externally of a housing, comprising:

(a) a contact spring formed from a sheet of resilient conductive material, said contact spring being reversely bent to define at least three open-ended generally tulip-shaped receptacles each having a pair of generally parallel longitudinal leg portions connected at one end by a transverse connecting portion, (b) said contact spring being operable to electrically connect a conductor inserted in one receptacle of said contact spring with a bus bar inserted into another receptacle of said contact spring; and (c) at least two parallel laterally-spaced bus bars arranged in end-overlapping relation, the adjacent ends of said bus bars extending into separate receptacles of, and in electrical engagement with, said spring contact.

3. A resilient electrical contact for connecting an electrical component with a bus bar system arranged externally of a housing, comprising:

(a) a contact spring formed from a sheet of resilient conductive material, said contact spring being reversely bent to define at least three open-ended generally tulip-shaped receptacles each having a pair of generally parallel longitudinal leg portions connected at one end by a transverse connecting portion, (b) said contact spring being operable to electrically connect a conductor inserted in one receptacle of said contact spring with a bus bar inserted into another receptacle of said contact spring; and (c) a resilient generally U-shaped cover spring partially enclosing said contact spring and operable to bias together the outermost longitudinal legs of said contact spring, said cover spring having:

(1) a pair of longitudinal leg portions extending adjacent the outer surfaces of the outermost longitudinal leg portions of said contact spring, and (2) a transverse portion connected between a pair of adjacent ends of said cover longitudinal leg portions.

4. A resilient electrical contact as defined in claim 3, and further including:

(c) a housing containing a chamber in which is mounted an electrical component, said housing having a wall opening communicating with said chamber;

(d) a bus bar system comprising a plurality of bus bar lines arranged externally of and adjacent said housing;

(e) a support socket arrangement supporting said contact spring externally of said housing adjacent said wall opening, at least one bus bar line of said bus bar system extending into one of the receptacles of said contact spring; and (f) an electrical connector having a first end connected with said electrical component, said electrical connector extending through said housing wall opening toward electrical engagement within another receptacle of said contact spring, whereby said electrical component is connected by said contact spring with said at least one bus bar line.

5. A resilient electrical contact as defined in claim 3, wherein said contact spring has a generally W-shaped cross-sectional configuration defining three receptacles.

6. A resilient electrical contact as defined in claim 3, wherein said contact spring has a generally double-W-shaped cross-sectional configuration defining five receptacles.

7. A resilient electrical contact as defined in claim 3, wherein successive receptacles of said contact spring have openings facing in opposite directions.

8. A resilient electrical contact as defined in claim 3, wherein the opposed surfaces of at least two successive longitudinal contact spring portions define a receptacle including inwardly directed projections for engaging a conductor that is inserted into that receptacle.

9. A resilient electrical contact as defined in claim 3, wherein said contact spring is formed from a single sheet of strip material.

10. A resilient electrical contact as defined in claim 3, wherein said cover spring transverse portion contains an opening receiving at least one bent portion of said contact spring.

11. A resilient electrical contact as defined in claim 10, wherein the longitudinal side walls of said cover spring include tongue portions that extend into said opening, said tongue portions having end portions that are biased toward engagement with the outer surfaces of the outermost longitudinal leg portions of said contact spring.

* * * * *